US006627146B1

(12) United States Patent
McKibben et al.

(10) Patent No.: US 6,627,146 B1
(45) Date of Patent: Sep. 30, 2003

(54) STOPPER MODULE DEVICE FOR A CASTING MACHINE FURNACE APPARATUS

(75) Inventors: Kenneth D. McKibben, Defiance, OH (US); Daniel D. Minor, Cadillac, MI (US); William W. Seaton, Dexter, MI (US); Khushal Wardak, Whitehall, MI (US); Miroslav Jaksic, Brighton, MI (US); Diane Zekind, Farmington Hills, MI (US); Karl D. Voss, West Bloomfield, MI (US)

(73) Assignee: Hayes Lemmerz International, Inc., Northville, MI (US)

( * ) Notice: Subject to any disclaimer, the term of this patent is extended or adjusted under 35 U.S.C. 154(b) by 377 days.

(21) Appl. No.: 09/751,326

(22) Filed: Dec. 28, 2000

(51) Int. Cl.[7] ..... C21C 5/48
(52) U.S. Cl. ..... 266/271; 266/239
(58) Field of Search ..... 266/239, 271; 164/248, 303, 306

(56) References Cited

U.S. PATENT DOCUMENTS 1,486,751 A * 3/1924 Hult ..... 164/306
3,206,301 A * 9/1965 Daubersy ..... 164/303
5,215,141 A 6/1993 Kuhn et al.
5,662,859 A * 9/1997 Noda ..... 266/239
5,700,422 A * 12/1997 Usui et al. ..... 266/239
5,948,352 A * 9/1999 Vender Jagt et al. ..... 266/239

FOREIGN PATENT DOCUMENTS

JP 357094463 A * 6/1982 ..... 164/306

* cited by examiner

*Primary Examiner*—Scott Kastler
(74) *Attorney, Agent, or Firm*—MacMillan, Sobanski & Todd, LLC

(57) ABSTRACT

This invention relates to a casting machine furnace apparatus including a casting machine furnace, a supply furnace in fluid communication with the machine furnace and operative to supply a molten metal to the machine furnace, and a stopper module device disposed in a fluid path between the casting machine furnace and the supply furnace. The stopper module device includes a block housing and a stopper assembly. The block housing includes an inlet opening and an outlet opening, and is disposed in the fluid path. The stopper assembly is supported for movement relative to the inlet opening of the block housing between a working position, wherein the molten metal flows from the supply furnace to the casting machine furnace, and a non-working position, wherein the flow of molten metal is prevented.

15 Claims, 4 Drawing Sheets

STOPPER MODULE DEVICE FOR A CASTING MACHINE FURNACE APPARATUS

BACKGROUND OF THE INVENTION

This invention relates in general to a casting machine furnace apparatus and in particular to an improved stopper module device for use with such a casting machine furnace apparatus.

Pressure pouring of molten metal from a casting machine furnace to fill a mold cavity has been used for several decades. At room temperature, the metals are solid and become fluid when melted with sufficient heat. It is known to use a low pressure countergravity casting apparatus to cast molten metal into a mold. One example of such an apparatus is described in U.S. Pat. No. 5,215,141. Basically, in a low pressure countergravity casting apparatus, molten metal is supplied to a casting apparatus by a machine furnace under pressure. The molten metal is first received into a crucible of the machine furnace. The molten metal in the crucible is then transported to a mold through a feed tube. One problem in managing the molten metal has been optimally replenishing the machine furnace with molten metal. Thus, it would be desirable to develop an apparatus to be used in the replenishing of the machine furnace with molten metal and method for the same which is simple and reliable.

SUMMARY OF THE INVENTION

This invention relates to a casting machine furnace apparatus including a casting machine furnace, a supply furnace in fluid communication with the machine furnace and operative to supply a molten metal to the machine furnace, and a stopper module device disposed in a fluid path between the casting machine furnace and the supply furnace. The stopper module device includes a block housing and a stopper assembly. The block housing includes an inlet opening and an outlet opening, and is disposed in the fluid path. The stopper assembly is supported for movement relative to the inlet opening of the block housing between a working position, wherein the molten metal flows from the supply furnace to the casting machine furnace, and a non-working position, wherein the flow of molten metal is prevented.

Other advantages of this invention will become apparent to those skilled in the art from the following detailed description of the preferred embodiment, when read in light of the accompanying drawings.

DESCRIPTION OF THE PREFERRED EMBODIMENT

Figure 1:
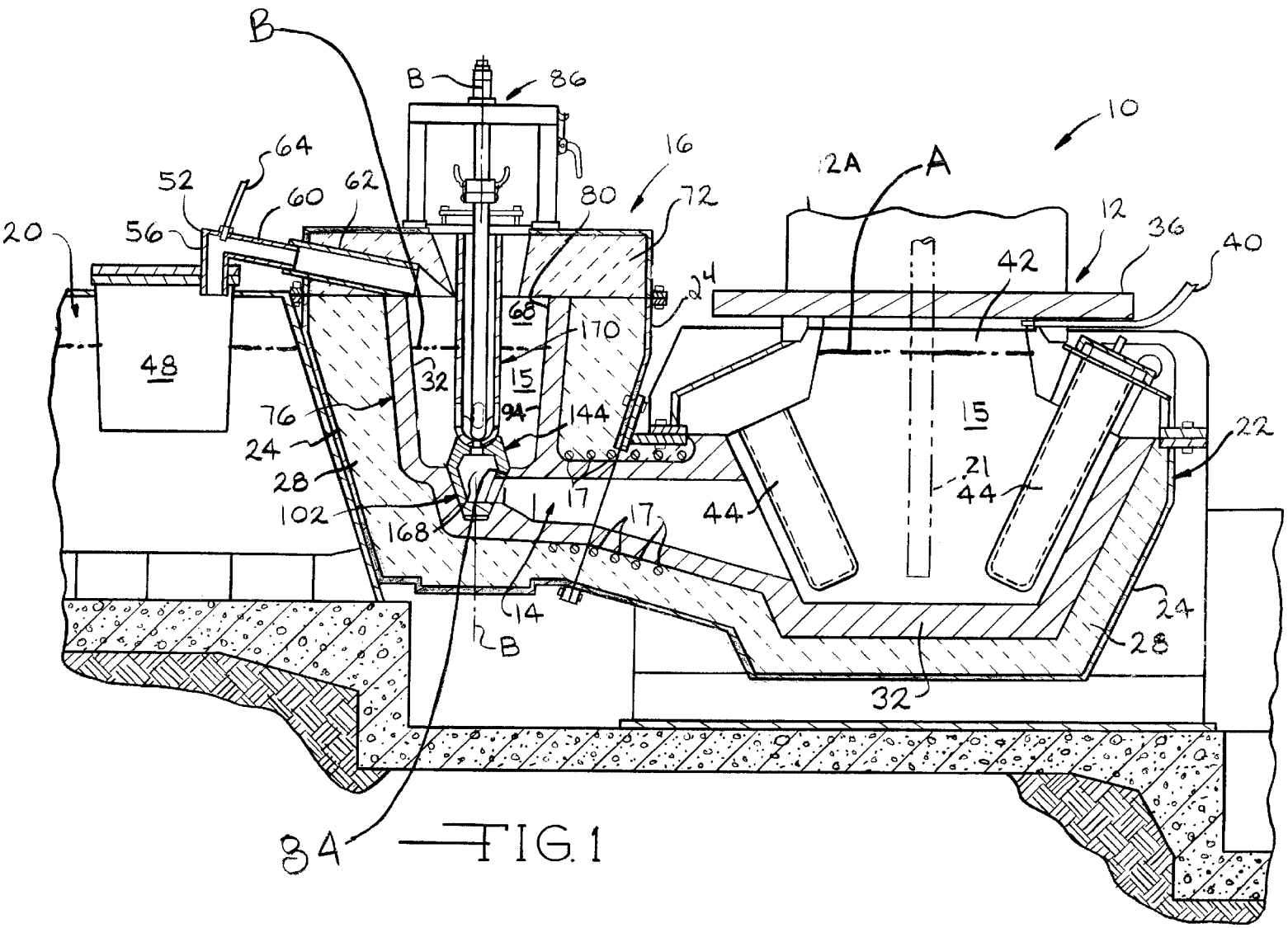
FIG. 1 is a partial sectional elevation view of a casting machine furnace apparatus according to the invention.

Referring to the drawings, FIG. 1 illustrates a casting machine furnace apparatus, indicated generally at 10, in accordance with the present invention. As shown therein, the illustrated casting machine furnace apparatus 10 includes a casting machine furnace 12 in fluid communication with a supply furnace 16 which supplies the casting machine furnace 12 with molten metal 15 through a passageway 14. The passageway 14 may include one or more suitable heating coils 17 proximate thereto, which are operative to generally prevent the molten metal 15 from cooling excessively as it passes through the passageway 14. The molten metal 15 is supplied to the supply furnace 16 by a holding furnace 20.

The machine furnace 12 preferably supplies the molten metal 15 to a casting apparatus (partially shown at 12A) thereof through a stalk tube 21 to produce a molded part (not shown); however, the machine furnace 12 can supply the molten metal 15 to any other suitable device or location. An example of a casting apparatus 12A which can be supplied with the molten metal 15 is disclosed in U.S. Pat. No. 5,215,141 to Kuhn et al., the disclosure of which is incorporated herein by reference. Thus, it can be seen that in the illustrated embodiment, the molten metal 15 generally flows in a "downstream" direction from the holding furnace 20 through the supply furnace 16 to the casting machine furnace 12 and to the casting apparatus 12A.

The illustrated casting machine furnace 12 includes a crucible 22 having an outer wall 24 covered by an intermediate insulation layer 28. The insulation layer 28 is preferably made of a material that does not transfer heat well. The insulation layer 28 is covered by and supports an inner liner 32. The inner liner 32 is preferably made of a material that does transfer heat well. Preferably, the inner liner 32 is made of a silicon carbide material. Alternatively, the inner liner 32 can be made from other suitable materials.

The casting machine furnace 12 further includes a cover 36 made of a suitable type of material, preferably an insulating type of material. The casting machine furnace 12 is provided with a fluid inlet 40 to allow a suitable fluid 42 to be selectively added to the casting machine furnace 12. The fluid inlet 40 can be provided in the cover 36 as shown, or can be provided in the cover 36 at any suitable location. Preferably, the fluid 42 is a gas that does not interfere with the physical or chemical properties of the molten metal 15 in the casting machine furnace apparatus 10. A suitable fluid 42 which can be used is nitrogen gas. In FIG. 1, a dotted line A is provided and is used to illustrate the associated levels of the molten metal 15 and the gas 42 in the casting machine furnace 12.

The illustrated casting machine furnace 12 preferably includes one or more heating elements 44 (two of such heating elements 44 being illustrated in FIG. 1). As shown in FIG. 1, at least a portion of each of the heating elements 44 preferably extends into the molten metal 15 in the casting machine furnace 12.

The holding furnace 20 is a suitably shaped vessel designed to hold the molten metal 15. The illustrated holding furnace 20 includes a pump 48. The pump 48 is provided to pump the molten metal 15 from the holding furnace 20 to the supply furnace 16. Any suitable pump 48 can be used for this purpose. One pump 48 which can be used is a Lindberg Varco 100 pump, manufactured by Lindberg/MPH of Riverside, Mich. The pump 48 is operative to move the molten metal 15 from the holding furnace 20 to the supply furnace 16 through a conduit 52.

The illustrated conduit 52 is a generally L-shaped pipe and includes a first generally vertical portion 56 in fluid communication with a second downwardly extending portion 60. Preferably, the conduit 52 is a ceramic lined discharge elbow and is available from Lindberg/MPH of Riverside, Mich. The downwardly extending portion 60 is operatively joined to a tube 62. Preferably, the tube 62 is a silicon carbide ceramic tube. Alternatively, the tube can be made from other suitable materials.

The conduit 52 includes a fluid inlet 64 provided therein to allow a suitable fluid 68 to be added to the conduit 52. Preferably, the fluid 68 is a gas that does not interfere with the physical or chemical properties of the molten metal 15. A suitable fluid which can be used is nitrogen gas.

The illustrated supply furnace 16 includes the outer wall 24 covered by the intermediate insulation layer 28. The insulation layer 28 is covered by and supports the inner liner 32. The tube 62 extends through the outer wall 24, the insulation layer 28, and the inner liner 32 of the supply furnace 16 to allow the molten metal 15 to be supplied from the holding furnace 20 to the supply furnace 16. In FIG. 1, a dotted line B is provided and is used to illustrate the associated levels of the molten metal 15 and the gas 42 in the supply furnace 16. The illustrated supply furnace 16 further includes a cover 72 made of a suitable type of material, preferably an insulating type of material. In the preferred embodiment, the casting machine furnace 12 and the supply furnace 16 include common components, namely the outer wall 24, the insulation layer 28, and the inner liner 32. Alternatively, the construction of the casting machine furnace 12 and the supply furnace 16 can be other than illustrated if so desired.

The inner liner 32 of the supply furnace 16 is operative to define a receptacle 76. The receptacle 76 includes a first or upper opening 80 and a second or lower opening 84. The top opening 80 is defined by a side wall 94 of the receptacle 76. The bottom opening 84 is formed in an end wall 98 of the receptacle 76. The top opening 80 is covered by the cover 72. The supply furnace 16 includes a stopper moving device 86 for a purpose described herein.

Figure 2:
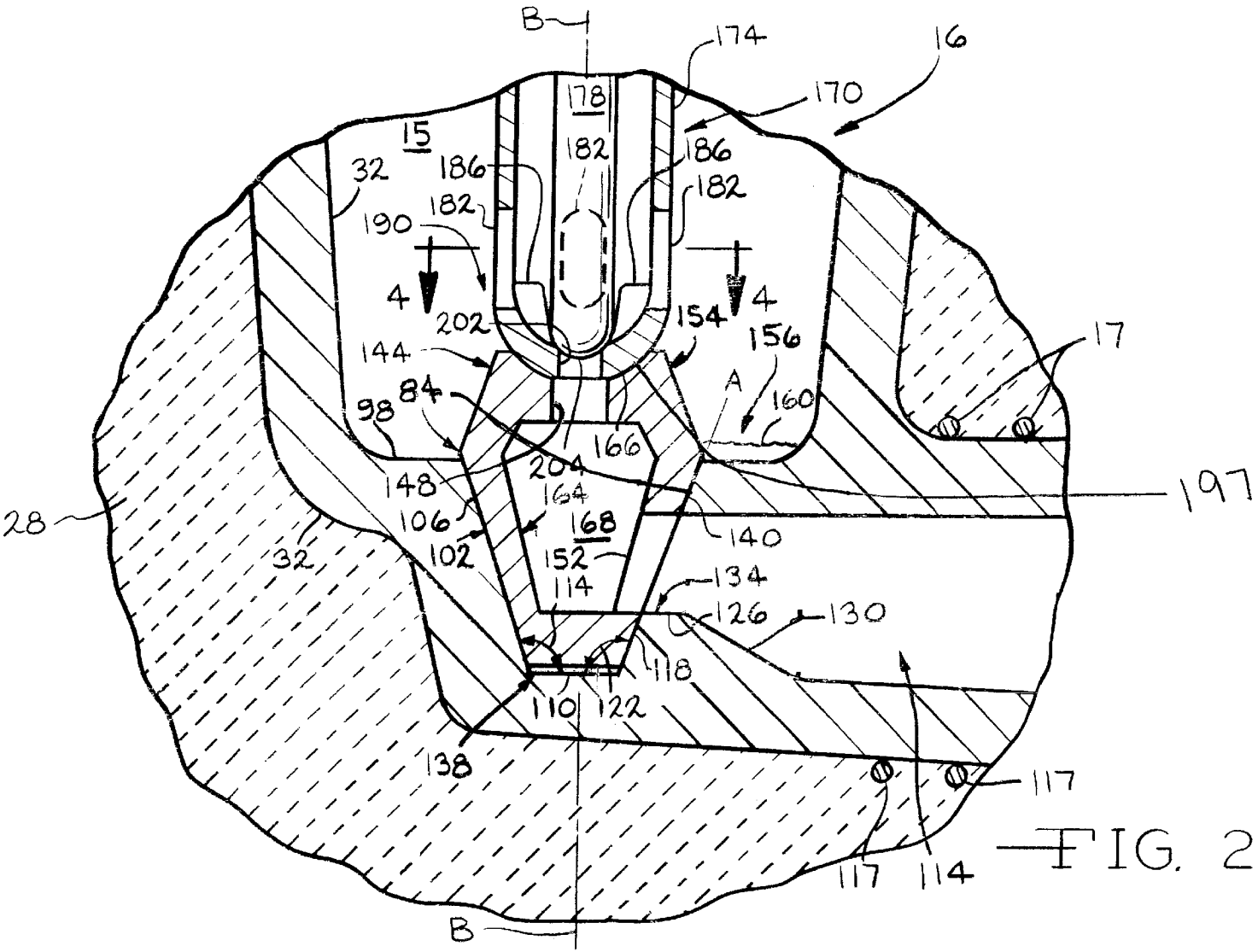
FIG. 2 is a sectional view of a portion of the casting machine furnace apparatus illustrated in FIG. 1, showing a stopper module device of the system, the stopper module device being shown in a closed position.

Referring now to FIG. 2, the lower end 98 of the receptacle 76 includes a stopper seating block housing 102. The illustrated stopper seating block housing 102 includes a first contact surface 106, a bottom surface 110, a second contact surface 118, a raised surface 126, a downwardly sloping transition surface 130, and a third contact surface 140. The first contact surface 106 is oriented at an angle 114 relative to the bottom surface 110, and the second contact surface 118 is oriented at an angle 122 relative to bottom surface 110. Preferably, in the illustrated embodiment, the third contact surface 140 and the second contact surface 118 are aligned along an axis A. The second contact surface 118, the raised surface 126, and the transition surface 130 form a protrusion 134 located above the bottom surface 110. A notch 138 is formed in the stopper seating block housing 102 by the first contact surface 106, the bottom surface 110, and the second contact surface 118.

The supply furnace 16 includes a stopper seating block 144. The stopper seating block 144 is preferably removable to facilitate maintenance and cleaning of the supply furnace 16. The stopper seating block 144 is preferably made of a material that does transfer heat well. The illustrated stopper seating block 144 includes a first orifice 148 and a second orifice 152. The first orifice 148 is formed in an upper end portion 154 of the stopper seating block 144. The upper end portion 154 of the stopper seating block 144 is located above the end wall 98 of the receptacle 76 to define a receptacle 156. The receptacle 156 is operative to receive or collect sludge 160 or other heavy impurities from the molten metal 15 in the supply furnace 16.

The upper end portion 154 defines a stopper module seat surface 166. The illustrated stopper module seat surface 166 is defined by a generally inwardly curved or rounded surface. The stopper seating block 144 defines a fluid chamber 168 in fluid communication with the first orifice 148 and the passageway 14 via the second orifice 152.

The stopper seating block 144 seats in the stopper seating block housing 102. In this position, a lower end surface 164 of the stopper seating block 144 is preferably slightly spaced from contact with the bottom surface 110 of the stopper seating block housing 102. Also, a tapered side wall 167 of the stopper seating block 144 contacts the first contact surface 106, the second contact surface 118, and the third contact surface 140 of the stopper seating block housing 102. The notch 138 and the protrusion 134 cooperate to support the lower portion 164 of the stopper seating block 144.

Figure 3:
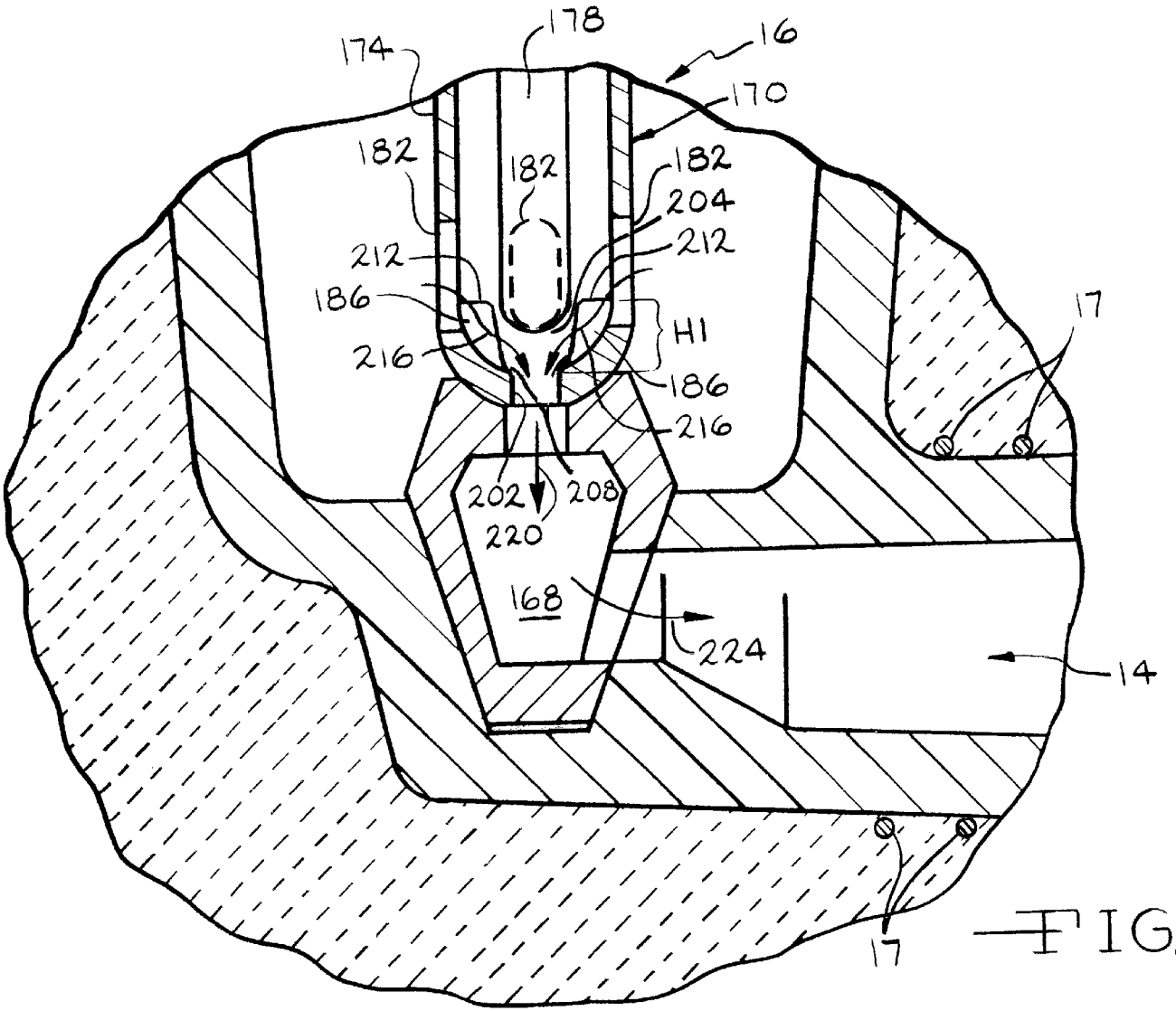
FIG. 3 is sectional view similar to FIG. 2 with the stopper module device being show in a raised position.
Figure 4:
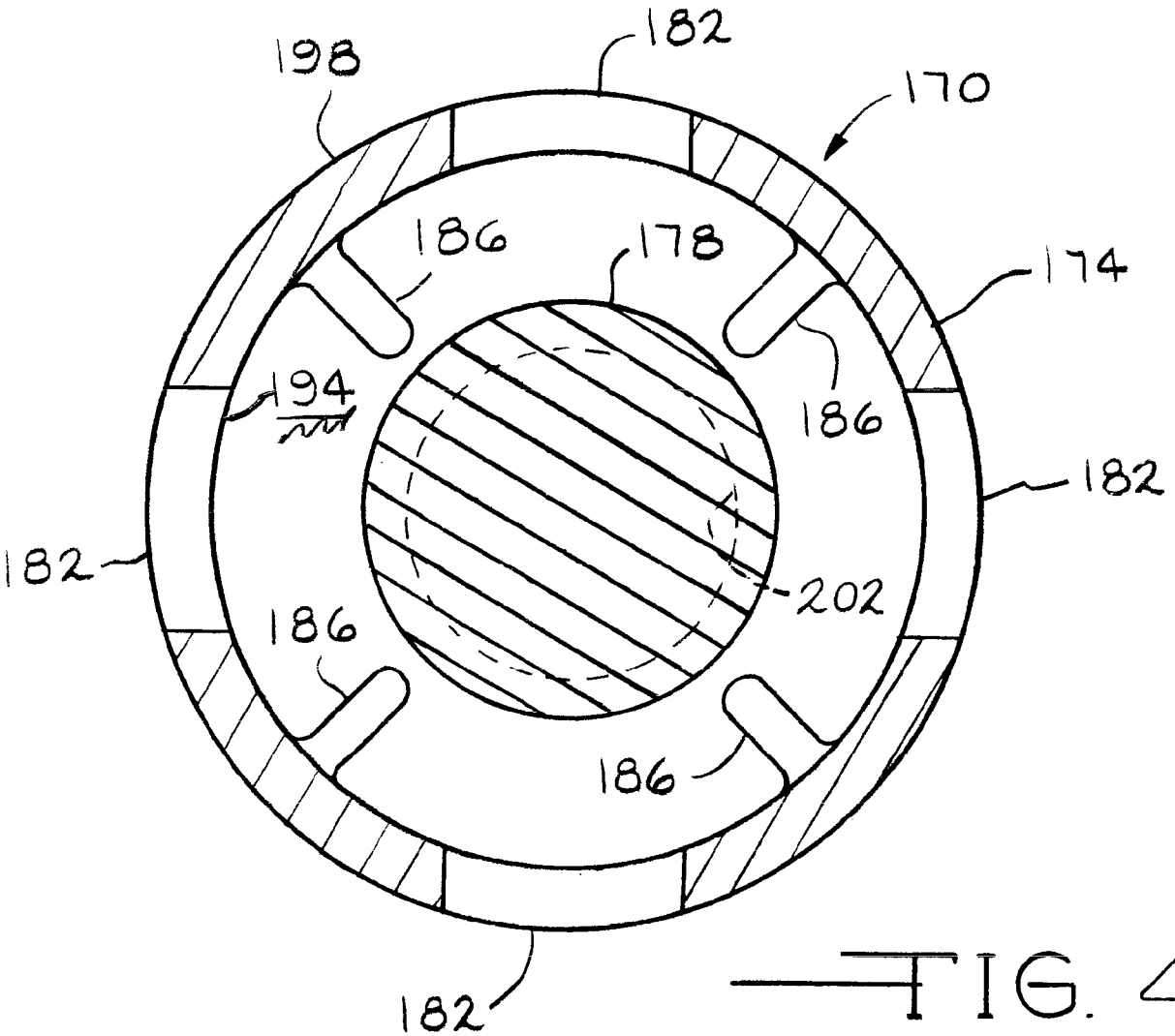
FIG. 4 is a top plan view of a portion of the stopper module device taken along line 4—4 of FIG. 2.

The casting machine furnace apparatus 10 further includes a stopper module, indicated generally at 170. In FIGS. 1 and 2, the stopper module 170 is shown in a closed or seated position in the stopper seating block 144. In FIG. 3, the stopper module 170 is shown in a raised or unseated position in the stopper seating block 144. The stopper module 170 includes a stopper housing 174 and a stopper 178. The illustrated stopper housing 174 includes four inlet or feed orifices 182, shown in FIG. 4. The orifices 182 are preferably equally spaced circumferentially around the stopper housing 174. The illustrated stopper housing 174 further includes four shoulders or protuberances 186. The illustrated shoulders 186 are located at a lower end 190 of the stopper housing 174 and extend generally radially inwardly relative thereto. As shown in FIG. 4, the shoulders 186 are slightly spaced apart from contact with the stopper 178. The illustrated stopper 178 is generally rod-like cylindrical structure and defines a longitudinal axis B. As will be discussed, the stopper 178 is movable relative to the stopper housing 174 along the axis B by the stopper moving device 86.

The stopper housing 174 further includes an inner surface 194 and an outer surface 198. The stopper housing 174 includes a lower curved or rounded outer end surface 197 having an outer surface profile which generally corresponds to the surface of the stopper module seat 166. The stopper housing 174 includes a lower curved or rounded inner surface 199 having an inner surface profile which generally corresponds to the outer surface profile of a tip 204 of the stopper 178 adjacent a lower orifice 202 of the stopper housing 174. Thus, it can be seen that when the stopper 178 is in the lowered position shown in FIGS. 1 and 2, it substantially prevents molten metal 15 from flowing from the supply furnace 16 to the passageway 14 and the machine furnace 12.

As shown in FIG. 3, the illustrated shoulders 186 of the stopper housing 174 define a height H1. The stopper housing 174 also includes a seat surface 208 proximate the lower orifice 202. In the illustrated embodiment, the seat surface 208 of the stopper housing 174 is preferably rounded and the height H1 is defined from about an upper ledge 212 of the shoulder 186 to about the valve seat 208. It will be appreciated that in FIG. 3 the tip 204 of the stopper 178 is spaced apart from the seat surface 208. In the illustrated embodiment of the stopper module 170, the tip 204 of the stopper 178 is preferably not movable above the upper ledge 212 of the shoulders 186. Thus, the tip 204 of the stopper 178 is not movable along the axis B by a distance of more than the height H1.

The stopper 178 in the raised position of FIG. 3 is operative to allow the molten metal 15 to flow from the supply furnace 16 to the chamber 168. To accomplish this, the molten metal 15 flows through the feed orifices 182 of the stopper housing 174, past the shoulders 186, through the lower orifice 202 of the stopper housing 174 (as indicated by the arrows 216), and through the orifice 148 into the chamber 168 (as indicated by the arrow 220). From the chamber 168, the molten metal 15 flows into the passageway 14 (as indicated by the arrow 224).

The stopper module 170 in the supply furnace 16 provides for a more desirable use of the casting machine furnace apparatus 10. It will be appreciated that when the stopper 178 is in the lowered position, the machine furnace 12 can be pressurized. The machine furnace 12 is pressurized by the addition of the fluid 42 through the fluid inlet 40. The added fluid 42 allows the molten metal 15 in the machine furnace 12 to travel through the stalk tube 22 to the casting apparatus 12A. The addition of the fluid 68 through the fluid inlet 64 allows the supply furnace 16 to be pressurized. Pressurization of the supply furnace 16 is desirable in that the pressure in the machine furnace 12 is better maintained when the supply furnace 16 is pressurized and the stopper 178 is raised. When the pressure in the machine furnace 12 and the pressure in the supply furnace 16 are similar, the pressure in the machine furnace 12 is not as likely to fluctuate. Fluctuations in the pressure in the machine furnace 12 can lead to problems in the resultant molded part which is produced by the casting apparatus 12A.

In accordance with the provisions of the patent statutes, the principle and mode of operation of this invention have been described and illustrated in its preferred embodiments. However, it must be understood that the invention may be practiced otherwise than as specifically explained and illustrated without departing from the scope or spirit of the attached claims.

What is claimed is:

1. A casting machine furnace apparatus comprising:

a casting machine furnace;

a supply furnace in fluid communication with said machine furnace, said supply furnace operative to supply a molten metal to said machine furnace; and a stopper module device disposed in a fluid path between said casting machine furnace and said supply furnace, said stopper module device including a stopper seating block and a stopper assembly, said stopper seating block including an inlet opening and an outlet opening, said stopper seating block disposed in said fluid path, said stopper assembly supported for movement relative to said inlet opening of said stopper seating block between a working position, wherein the molten metal flows from said supply furnace to said casting machine furnace, and a non-working position, wherein the flow of molten metal is prevented;

wherein said stopper assembly includes an outer housing and an internal stopper supported relative to said outer housing for movement relative thereto, and wherein a lower inner portion of said outer housing includes a plurality of shoulders including an upper ledge, said internal stopper including a lower tip, and said tip not movable relative to said housing above said upper ledge of said shoulders.

2. The casting machine furnace apparatus according to claim 1 wherein said inlet opening of said stopper seating block is located above a lower wall of said supply furnace.

3. The casting machine furnace apparatus according to claim 1 wherein said lower inner portion of said outer housing includes a plurality of orifices formed therein.

4. The casting machine furnace apparatus according to claim 1 wherein said stopper seating block of said stopper module device is a removable component.

5. The casting machine furnace apparatus according to claim 3 wherein said lower portion of said outer housing includes four orifices formed therein.

6. The casting machine furnace apparatus according to claim 1 wherein said lower inner portion of said outer housing includes four shoulders.

7. The casting machine furnace apparatus according to claim 1 wherein said shoulders extend generally radially inwardly relative to said outer housing.

8. A casting machine furnace apparatus comprising:

a casting machine furnace;

a supply furnace in fluid communication with said machine furnace, said supply furnace operative to supply a molten metal to said machine furnace; and a stopper module device disposed in a fluid path between said casting machine furnace and said supply furnace, said stopper module device including a stopper seating block and a stopper assembly, said stopper seating block including an inlet opening and an outlet opening, said stopper seating block disposed in said fluid path, said stopper assembly supported for movement relative to said inlet opening of said stopper seating block between a working position, wherein the molten metal flows from said supply furnace to said casting machine furnace, and a non-working position, wherein the flow of molten metal is prevented;

wherein said stopper assembly includes an outer housing and an internal stopper supported relative to said outer housing for movement relative thereto, and wherein a lower inner portion of said outer housing includes a plurality of shoulders, said shoulders spaced apart from contact with said internal stopper.

9. The casting machine furnace apparatus according to claim 8 wherein said inlet opening of said stopper seating block is located above a lower wall of said supply furnace.

10. The casting machine furnace apparatus according to claim 8 wherein said shoulders include an upper ledge, said internal stopper includes a lower tip, and said tip is not movable relative to said housing above said upper ledge of said shoulders.

11. The casting machine furnace apparatus according to claim 8 wherein said lower inner portion of said outer housing includes a plurality of orifices formed therein.

12. The casting machine furnace apparatus according to claim 8 wherein said stopper seating block of said stopper module device is a removable component.

13. A casting machine furnace apparatus comprising:

a casting machine furnace;

a supply furnace in fluid communication with said machine furnace, said supply furnace operative to supply a molten metal to said machine furnace; and a stopper module device disposed in a fluid path between said casting machine furnace and said supply furnace, said stopper module device including a removable stopper seating block and a stopper assembly, said stopper seating block including an inlet opening and an outlet opening, said stopper seating block disposed in said fluid path, said stopper assembly supported for movement relative to said inlet opening of said stopper seating block between a working position, wherein the molten metal flows from said supply furnace to said casting machine furnace, and a non-working position, wherein the flow of molten metal is prevented;

wherein said stopper assembly includes an outer housing and an internal stopper supported relative to said outer housing for movement relative thereto, and wherein a lower inner portion of said outer housing includes a plurality of shoulders spaced apart from contact with said internal stopper, said shoulders including an upper ledge, said internal stopper including a lower tip, and said tip not movable relative to said housing above said upper ledge of said shoulders.

14. The casting machine furnace apparatus according to claim 13 wherein said inlet opening of said stopper seating block is located above a lower wall of said supply furnace.

15. The casting machine furnace apparatus according to claim 13 wherein said lower inner portion of said outer housing includes a plurality of orifices formed therein.

* * * * *